United States Patent [19]

May

[11] Patent Number: 4,634,319

[45] Date of Patent: Jan. 6, 1987

[54] METHOD AND APPARATUS FOR LIFTING AND SUPPORTING STRUCTURES

[75] Inventor: Donald R. May, 720 Belle Vista Dr., Independence, Mo. 64055

[73] Assignees: Donald R. May; Sandra L. May, both of Independence, Mo.

[21] Appl. No.: 717,142

[22] Filed: Mar. 28, 1985

[51] Int. Cl.[4] ..... E02D 5/00

[52] U.S. Cl. ..... 405/230

[58] Field of Search ..... 405/229, 230

[56] References Cited

U.S. PATENT DOCUMENTS

| | | | |
|---|---|---|---|
| 3,685,301 | 8/1972 | Heacox | 405/230 |
| 3,796,055 | 3/1974 | Mahony | 405/230 |
| 3,902,326 | 9/1975 | Langenbach, Jr. | 405/230 |
| 4,070,867 | 6/1978 | Cassidy | 405/230 X |

*Primary Examiner*—Albert J. Makay
*Assistant Examiner*—Steven E. Warner
*Attorney, Agent, or Firm*—Schmidt, Johnson, Hovey & Williams

[57] ABSTRACT

A method of lifting and supporting structures, such as buildings or the like, which includes the steps of exposing the base of the structure; attaching a shoe to the base of the structure and then attaching a driving assembly to the shoe whereby the assembly may be utilized to successively and individually drive piers beneath the structure. After the piers are driven a separate pier plate unit is fitted over the end of each of the piers, which piers have been cut off at ground level. Once in place, the pier plate unit is used to support lifting means which operate between the pier plate unit and the structure to lift the structure to the desired position. After the structure has reached this position permanent, adjustable supporting means are placed between the pier plate unit and the structure whereby to retain the structure in the desired position. The apparatus for carrying out the foregoing method includes the shoe which is attached to the structure; a pier driving assembly which is carried by the shoe; a pier which is driven by the driving assembly to a point beneath the structure; a pier plate unit which is fitted over the upper end of the pier after it has been driven and its upper end cut off at ground level; lifting means which is supported by the pier plate unit; and permanent supporting means which are finally positioned between the pier plate unit and the structure for permanently supporting the structure in its desired position.

7 Claims, 13 Drawing Figures

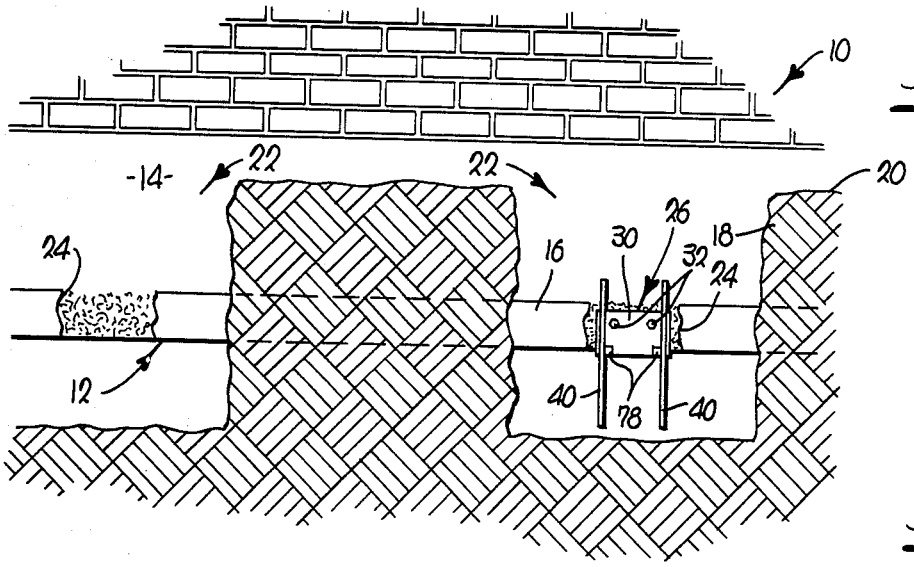
Fig. 1
Fig. 3
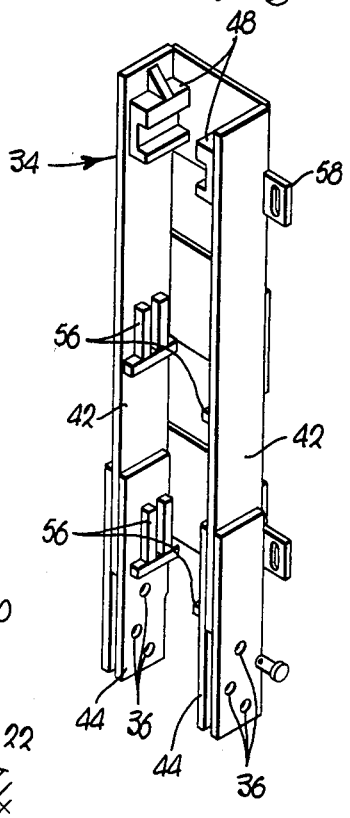
Fig. 2
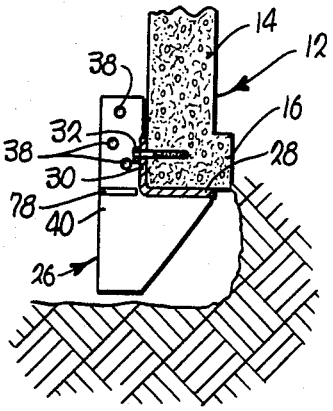
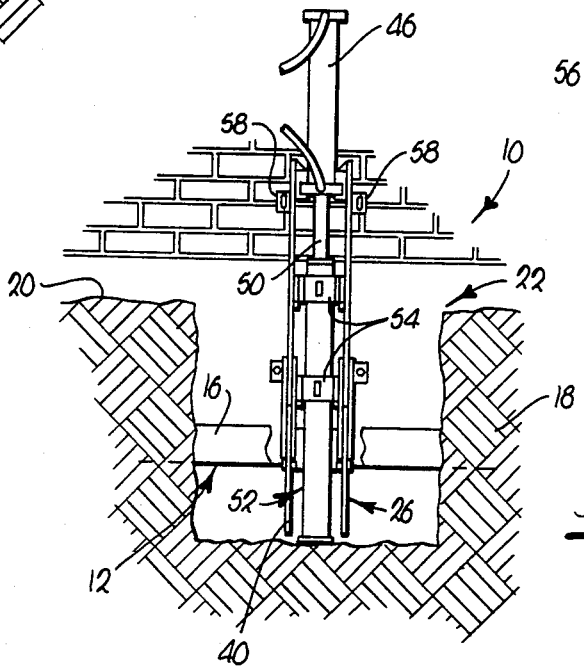
Fig. 4

Fig. 5
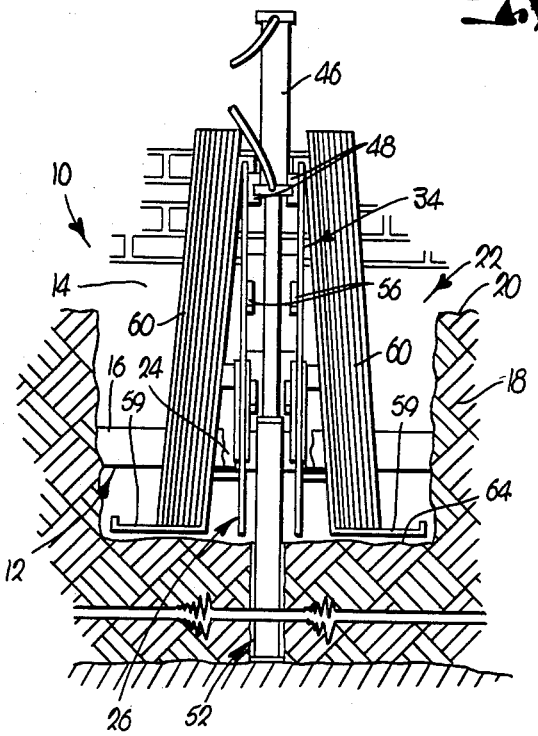
Fig. 11
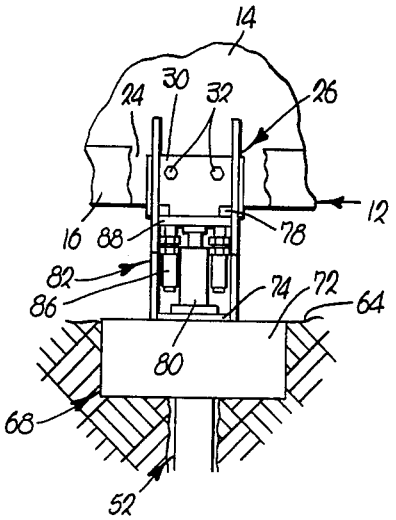
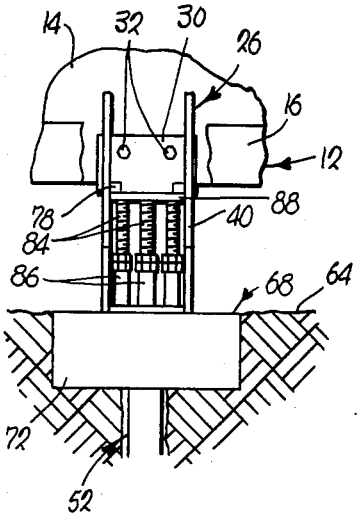
Fig. 13

METHOD AND APPARATUS FOR LIFTING AND SUPPORTING STRUCTURES

FIELD OF THE INVENTION

This method and apparatus relates to a system designed to lift and support structures, particularly buildings and the like which may have settled from their original desired position and need to be righted or leveled whereby to cure structural defects which may have occurred as a result of settlement of the structure. The method and apparatus permits the structure to be lifted to a desired position and to be supported in such position by a plurality of piers which have been driven beneath the structure whereby the load of the structure is carried on top of a plurality of individually driven piers.

BACKGROUND OF THE INVENTION

The invention consists of a method and apparatus utilized to lift and support structures which may have settled from their original position, the method being very simple and straight forward in operation and very economical. The method is readily accomplished by relatively simple equipment which is portable and may be moved into position by two persons. There is no need for heavy trucks or equipment which damage the property adjacent the structure and confined areas are accessible for utilization of the system.

The method involves driving, individually and one at a time, piers beneath the structure, the piers being driven to bedrock or to a measured design load strength, the piers preferably being of a mill rolled galvanized steel.

An advantage of the system is that the piers are individually driven and, after the piers have been put in place, a lifting means, which is placed atop a pier plate unit which has been fitted over the top end of the pier, may be utilized to lift the structure and then permanent supporting means are adjustably positioned between the pier plate unit and the structure and left in position whereby to permanently support the structure in its desired position.

The system overcomes shortcomings of prior art systems such as those disclosed in U.S. Pat. Nos. 3,796,055, issued Mar. 12, 1974 and 3,902,326, issued Sept. 2, 1975.

The advantages are gained by individual driving of the multiple piers normally required to ultimately support the structure and utilization of the pier plate unit which may be immediately positioned atop the pier and which does not require the pouring of concrete and waiting time, all to the end that the present system may be quickly, readily and economically utilized to lift a structure and to support the structure permanently in its desired position.

SUMMARY OF THE INVENTION

The invention consists of a method and apparatus for lifting and supporting structures which apparatus includes a shoe which is attached to the structure to be lifted and which shoe received a pier driving assembly whereby a plurality of piers may be individually driven beneath the structure; there being a pier plate unit which is fitted over the top of each driven pier and then utilized to support lifting means which span the opening between the pier plate unit and the structure whereby the structure may be lifted to its ultimate desired position, there being permanent supporting means which are positioned between the pier plate unit and the structure for permanently retaining the structure in its desired position.

The method is carried out by exposing the base of the structure; attaching a shoe to the base; connecting a pier driving assembly to the shoe and then using the assembly to drive a pier and ultimately multiple piers beneath the structure. The piers are successively and individually driven and, once all have been driven, the upper ends, above the ground, are cut off and a pier plate unit is placed over the top end of each driven pier. The pier plate unit is then driven onto the top of the pier and lifting means are placed on the pier plate unit and between the structure whereby the lifting means may be utilized to raise the structure to its desired position. Once raised, the structure is retained in its permanent position by supporting means which are adjustably positioned between the pier plate unit and the structure and which are adjusted to support the structure in its desired and permanent position.

BRIEF DESCRIPTION OF THE DRAWINGS

FIG. 1 is a fragmentary front elevational view of a structure to be lifted and supported and showing the shoe in place on the base of the structure;

FIG. 2 is a fragmentary side elevational view showing the shoe attached to the structure base;

FIG. 3 is a perspective view of the driving assembly;

FIG. 4 is a front elevational view, comparable to FIG. 1, and showing the driving assembly in position with respect to the structure and preparatory to driving a pier;

FIG. 5 is a view similar to FIG. 4 but showing a pier driving assembly which is provided with means for loading additional weight thereon to assist in driving the pier;

FIG. 11 is a front elevational view showing the structure lifted by the lifting unit;

FIG. 13 is a front elevational view showing the permanent supporting means in their final position and supporting the structure in its desired permanent position.

DESCRIPTION OF THE PREFERRED EMBODIMENT

Figure 6:
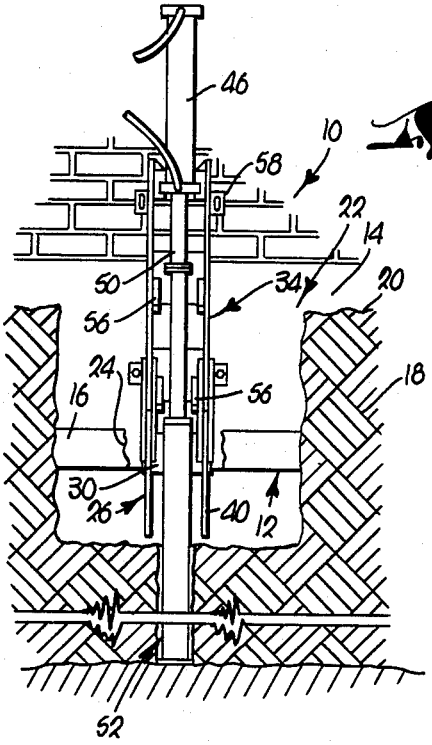
FIG. 6 is a front elevational view showing the pier driving assembly as it is conventionally used to extend the pier beneath the structure.

The method and apparatus hereinafter described in detail is intended for use in lifting and supporting a structure in the nature of a building 10, which building may be a residential or commercial building or, for that matter, any other structure which needs to be lifted and then permanently supported in a fixed and desired position.

A building such as 10 is normally provided with a footing or base 12 which is conventionally in the form of a poured concrete footing generally T-shaped in cross-sectional configuration whereby to present the normally vertical wall 14 of the structure 10 and laterally extending legs such as 16. The footing or base 12 is normally below ground level making it necessary to excavate earth 18 below the normal ground level 20 to gain access to the base 12.

In accomplishing the method of the present system, an excavation access area 22 is dug in the earth 18 surrounding the structure 10 whereby access may be gained to the lowermost edge of the footing or base 12. Such an excavation as 22 would be made at multiple locations along the base 12 of the structure 10 whereby to ultimately permit the placement of a plurality of piers adjacent the base 12 of structure 10.

Once an excavation such as 22 has been made to gain access to the base 12, a portion of the base 12 is broken away as at 24 to permit a shoe 26 to be attached to the base 12 as shown best in FIG. 2 of the drawing. Note that the shoe 26 has a seat portion 28 which is disposed beneath the base 12 in supporting relationship thereto and has a vertical wall or portion 30 which is against the exterior surface of the wall 14 and is attached thereto as by bolts 32.

Once the shoe 26 has been attached to the base 12 as described, a pier driving assembly, broadly designated as 34, is attached to the shoe 26 as by aligning a plurality of holes 36 in the pier driving assembly 34 with corresponding holes 38 in outwardly extending wings 40 of the shoe 26. The pier driving assembly consists of a pair of spaced apart upstanding plates 42 and, at the base end thereof, has inner plates 44 which cooperate with the outer plates 42 to straddle the wings 40 of the shoe 26 and thereby reinforce the attachment between the pier driving assembly 34 and the shoe 26.

Once the pier driving assembly 34 has been attached to the shoe 26, a drive cylinder 46 is placed in position on driving assembly 34 as by slipping the base of the cylinder 46 between two holding brackets 48 which are at the normally uppermost end of the assembly 34.

The cylinder 46 is a double acting piston and cylinder arrangement which drives a ram 50 which ram 50 extends downwardly therefrom as best shown in FIG. 4 whereby to engage the normally uppermost end of a pier 52. A pair of sleeves 54 coupled with the driving assembly 34 as through sleeve holders 56 serve to embrace the pier 52 and retain the same in the desired upright position as it is being driven.

It will be appreciated that the driving assembly 34 may be additionally attached to the structure as by utilizing tabs 58 and driving attaching means through openings provided therein and into the structure 10.

As shown in FIG. 6 of the drawing, the driving assembly 34 and ram 50 of drive cylinder 46 are used to drive the pier 52 into the earth 18 which surrounds the structure 10. The pier is pushed downwardly by the ram 50, operated by cylinder 46, until such time as the pier "bottoms out" either by striking bedrock or by being driven to its designed limits. The pier 52 is a compression pier, not a friction pier, and is driven into the earth until such time as it strikes rock or the maximum compression permitted by its design characteristics have been reached.

Once a pier such as 52 has been driven, additional piers are driven surrounding the structure 10. It is to be noted that the piers such as 52 are successively and individually driven and are not simultaneously driven, whereby each pier is individually placed in its maximum position. Such successive and individual driving of the pier such as 52 may be accomplished by placing a driving assembly such as 34 at a first location on the structure 10 and then subsequently moving it to additional locations or driving assemblies such as 34 may be placed at multiple locations about the structure and then successively used to drive the individual piers.

Once a pier such as 52 has been driven to its maximum depth and the remaining piers driven, as described above, there are a multitude of piers positioned at maximum locations about the structure. If resistance is encountered in driving the individual piers, a supplemental assembly, such as shown in FIG. 5 of the drawing, may be utilized to place additional weight on the pier as it is being driven. This supplemental assembly consists of a pair of wings 59 which are connected to the pier driving assembly 34 and then loaded with metal plates such as 60 whereby to supplement the weight which is normally placed on the driving assembly, it being noted that, since the assembly is connected to the structure at multiple locations, as through the shoe 26 and the brackets 58, a rather substantial load is placed on the pier 52 as it is driven to thereby supplement the pushing driving action accomplished by the ram 50.

Figure 8:
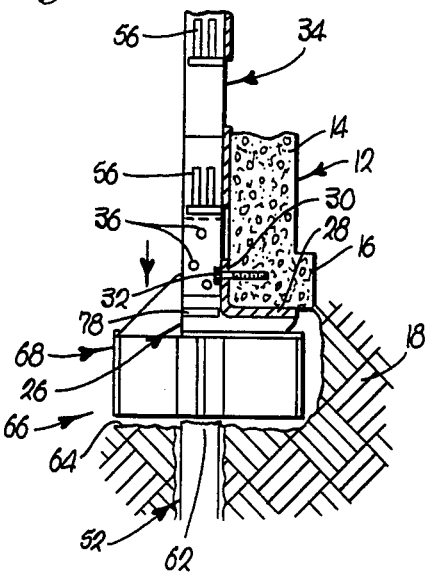
FIG. 8 is a side elevational view showing the driven pier with its upper, above ground end cut off and with the pier plate unit placed in the space between the top end of the pier and the structure and preparatory to being driven atop the pier.

Viewing FIG. 8 of the drawing, it is seen that when the pier 52 has been fully driven, the uppermost end 62 is cut off at ground level, ground level in this instance being as at 64 which is the bottom of the access area 22 which has been dug beneath the normal ground level 20 to gain access to the base 12 of the structure 10.

Once the pier top has been cut off to present the uppermost end 62, there is presented a space 66 between the top 62 of the pier 52 and the structure 10 and more particularly the seat 28 of the shoe 26. This space may be reached by going between the plates 42 of the drive assembly 34.

Figure 7:
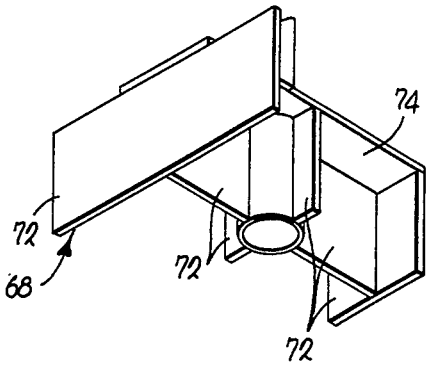
FIG. 7 is a perspective view of the pier plate unit.

Accordingly, a pier plate unit, best shown in FIG. 7 in perspective and designated by the numeral 68 is inserted into the space 66 and positioned in overlying relationship to the top 62 of the pier 52.

Figure 9:
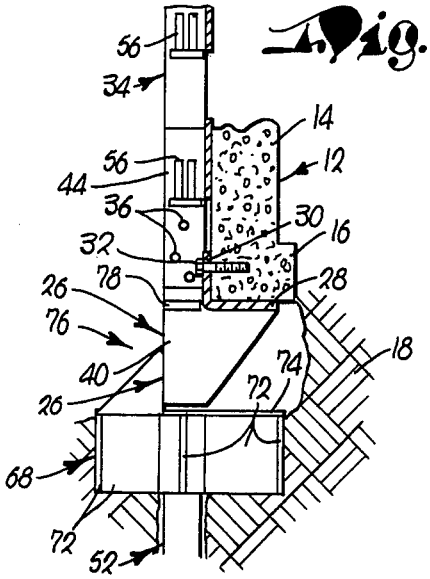
FIG. 9 is a side elevational view comparable to FIG. 8 but showing the pier plate unit atop its pier.

Once the pier plate unit is in such position, the ram 50 is then utilized to force the pier plate unit downwardly whereby a tube portion 70 of the pier plate unit is fitted over the uppermost end 62 of the pier 52 as is clearly shown in FIG. 9 of the drawing.

Pier plate unit 68 is provided with a number of downwardly extending fins 72 which enter the earth, as shown in FIG. 9 whereby to stabilize the pier plate unit atop pier 52 and prevent shifting movement thereof. The fins 72 all depend from a top, horizontal wall 74 of the pier plate unit 68, which top wall 74 is in a horizontal position when the pier plate unit 68 has been driven atop the pier 52, all as is best shown in FIG. 9 of the drawing.

Once the pier plate unit is so positioned, there is presented an opening 76 between the top wall 74 of the pier plate unit 68 and the bottom of the shoe 26. More specifically, this opening is between the upper surface of top wall 74 of the pier plate unit 68; a block 78 which is a part of the shoe 26 and seat 28; the block being in horizontal relationship and preferably parallel to the top wall 74 of the pier plate unit 68, as best shown in FIG. 10 of the drawing.

Figure 10:
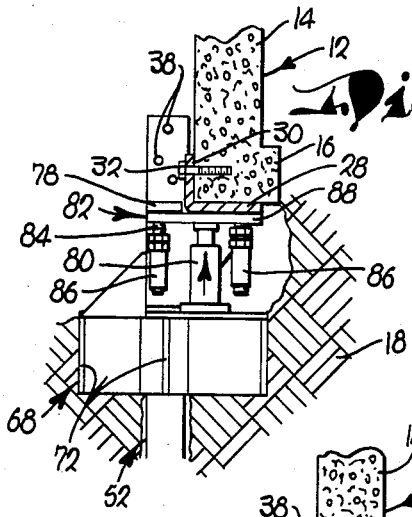
FIG. 10 is a side elevational view showing the lifting means in position atop the pier plate unit and in the opening between the pier plate unit and the structure.
Figure 12:
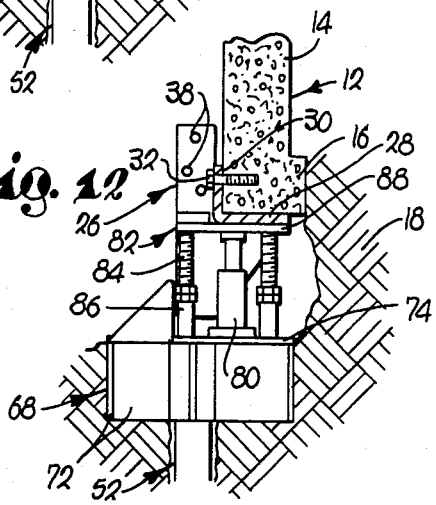
FIG. 12 is a side elevational view showing the structure lifted and with the permanent supporting means extending between the top of the pier plate unit and the structure.

Since the drive assembly 34 is normally removed after the pier plate unit 68 has been driven over the top of pier 52, access may be had to the opening 76 between the top 74 the block 78, and the seat 28 as described above, whereby to place lifting means in said opening 76 as shown for instance in FIGS. 10 and 12.

The lifting means is in the form of a hydraulic ram or jack 80 which has its bottom resting on the top wall 74 of pier plate unit 68.

As is apparent from FIG. 10 of the drawing, activation of the jack or ram 80 will serve to lift the structure inasmuch as the ram 80 is supported by the pier, which has been driven deep into the ground beneath the structure and is provided with a substantial base by the pier plate unit 68 which has been driven atop the pier 52.

Accordingly, the structure may be raised and lifted to its desired, normally level position by utilization of the jack 80.

Once the structure has been lifted and leveled, a plurality of permanent supporting means is utilized to fill the opening 76 and thereby permanently support the structure in its desired position.

The permanent supporting means are broadly designated by the numeral 82, are best shown in FIGS. 10, 12 and 13, and consist of a plurality of threaded studs 84 each having a collar 86 thereon whereby the collars may be adjusted to the desired position. The desired position is to have the collars engaging the upper or top wall 74 of the pier plate unit 68. The studs themselves are a part of the lifting unit which has been inserted in the opening 76.

Thus, the lifting means which is inserted in the opening, consists of the ram or jack 80, which supports a plate 88, which plate engages the block 78 and seat 28 of the shoe 26. The studs 84 are carried by the plate 88 and the collars 86 are adjustably threaded on the studs 84 whereby the collars may be lowered and brought into engagement with the pier plate unit.

Once the collars have been so adjusted, it will be appreciated that full support is provided between the pier plate unit and the structure whereby the structure is retained and supported permanently in its desired position. The ram or jack may be removed or, in the alternative, may be left in position to continue its supporting function on a permanent basis.

Even further, the permanent supporting assembly, as best shown in FIG. 13, may be ultimately welded in position, if desired, whereby to insure its position and stability as means for permanently supporting the structure in its desired position.

It will be appreciated that the arrangement described above may be used at multiple positions about the base of the structure 10 whereby to lift the structure until such time as it is in a lifted and normally level position and then retain the structure in this desired and permanent position. Manifestly, as many piers as are necessary may be driven and each would have a corresonding pier plate unit and lifting and permanent supporting means carried thereby all as described above, whereby the structure could be lifted into its desired position and permanently supported in such position

I claim:

1. Apparatus for lifting and supporting a building structure having a base comprising:

a vertically positioned pier driven in the ground adjacent the building structure and having an upper end proximal to the base of the building structure;

a pier plate unit fitted over the upper end of the driven pier;

a shoe attached to the base of the structure, said shoe being in spaced, overlying relationship to the pier plate unit;

temporary lifting means between the pier plate unit and the shoe for initially lifting the shoe and therefore the structure; and permanent supporting means finally positioned between the pier plate unit and the structure for supporting the structure in its final desired position.

2. Apparatus as set forth in claim 1, said shoe having a horizontal seat and a vertical wall, the seat being beneath the base of the structure, the vertical wall being attached to the base of the structure; and a pair of spaced-apart, generally triangular wings supporting the shoe, attached thereto and extending downwardly therefrom toward the pier plate unit.

3. Apparatus as set forth in claim 2, the lifting means being positioned between the spaced-apart wings, the shoe and the pier plate unit.

4. Apparatus as set forth in claim 3, the pier plate unit having a top wall, the seat of the shoe being parallel to said top wall, the lifting means acting upon said top wall and said seat when activated.

5. Apparatus as set forth in claim 4, the pier plate unit including a plurality of downwardly extending fins for insertion in the ground when the pier plate unit is fitted over the top of the pier to stabilize the pier and the pier plate unit.

6. Apparatus as set forth in claim 6, there being a pair of gusset plates carried by the top wall of the pier plate unit, corresponding to said wings and in engagement therewith for stabilizing the wings and the shoe as the lifting means are activated to lift the shoe and the structure.

7. Apparatus as set forth in claim 6, the pier being perpendicular to said pier plate unit at substantially the central portion thereof.

* * * * *